US005261659A

United States Patent [19]

Tierney

[11] Patent Number: 5,261,659

[45] Date of Patent: Nov. 16, 1993

[54] BASEBALL PITCH SIMULATOR BATTER TRAINING DEVICE

[76] Inventor: Joseph Tierney, 168 Old Bog Rd., Brewster, Mass. 02631

[21] Appl. No.: 11,238

[22] Filed: Jan. 29, 1993

[51] Int. Cl.[5] ..... A63B 69/00

[52] U.S. Cl. ..... 273/26 R

[58] Field of Search ..... 273/26 R, 88

[56] References Cited

U.S. PATENT DOCUMENTS 3,531,116 9/1970 Trzesniewski ..... 273/26 R
4,461,477 7/1984 Stewart ..... 273/26 R
4,708,343 11/1987 D'Ambrosio ..... 273/26 R

*Primary Examiner*—William H. Grieb

[57] ABSTRACT

An improved baseball pitch simulator batter training device comprised of a plurality of portable, height adjustable and individually placable standards supporting sequencing lights of approximate baseball size which are capable of being placed and timed in a manner to simulate the path speed, location, movement and visual appearance of various types of pitches traveling from the pitcher's release point to the ideal bat-ball contact point at home plate. These pitches could be fastballs or breaking balls from either a right-handed or left-handed pitcher as determined by the user and remain in that exact location until changed. By using a specially adapted bat, a full swing can be taken or the batter can select more specific learning variations, other than a full swing, that are offered by the nature of this device. In addition, at the precise instant the bat-ball contact light is illuminated, a sound device is activated as an added learning tool to aid the batter's perception of his timing.

3 Claims, 6 Drawing Sheets

CAM FIRING ORDER

| CAM FIRING ORDER AND SOCKET NUMBER | TO LAMP CORD LINE NUMBER | TO LIGHT SOURCE NUMBER |
|---|---|---|
| 1 | 1A | 1B (WINDUP LIGHT) |
| 2 | 2A | 2B (RELEASE POINT LIGHT) |
| 3 | 3A | 3B |
| 4 | 4A | 4B |
| 5 | 5A | 5B |
| 6 | 6A | 6B |
| 7 | 7A | 7B |
| 8 | 8A | 8B |
| 9 | 9A | 9B |
| 10 | 10A | 10B |
| 11 | 11A | 11B |
| 12 | 12A | 12B (BAT-BALL CONTACT LIGHT AND SOUND ACTIVATOR) |

BASEBALL PITCH SIMULATOR BATTER TRAINING DEVICE

THE FIELD OF INVENTION

The present invention relates to a baseball-softball batter training device and, in particular, to a device that duplicates the path, speed and movement of an actually pitched ball, and indicates audibly to the batter the precise moment of desirable bat-ball contact for that particular pitch.

BACKGROUND OF THE INVENTION

It is a widely held belief that the skill of hitting a baseball is one of the most difficult skills in sports to master. It is also held it is one of the most difficult to practice.

In a traditional batting practice, distractions arise that inhibit the ability of the batter to concentrate on the fundamental techniques that are the foundation for the development of proper batting procedures and skills. Even the distraction of attempting to make contact with a ball can present a learning problem. In an effort to attain momentary satisfaction, the tendency, especially among young batters, is to forgo form, techniques and discipline and just try to smack the ball. Some other difficulties and distractions in conventional batting practice are the inability of the pitcher to throw strikes, the delays of ball retrieval, the lack of time for ample quality swings, the fear of being hit by a pitched ball, adverse weather conditions, and limited available space especially if practice is indoors. These factors, as well as others, have contributed to a lack of means and opportunity for quality learning time in batting practice. Many batting-practice sessions could, in fact, be called bad-habit practice.

The advent of many types of mechanical pitching machines and stationary batting tees helped address some of the difficulties but, at best, they give limited batting experiences and need either significant space or extensive and expensive screening and netting arrangements. Electronic attempts to simulate the batting experience, such as "Apparatus for Baseball Batting Practice," D'Ambrosio, U.S. Pat. No. 4,708,343; "Electric Baseball Batting Game," Trzeniewski, U.S. Pat. No. 3,531,116; and "Method and Apparatus for Improving the Performance of a Batter," Stewart, U.S. Pat. No. 4,461,477 also helped address some of the difficulties but, due to the nature of these apparatus, they inherently lack the ability to simulate a situation whereby the batter can realistically experience the path, speed, movement, placement and visual perception of an actually pitched ball traveling from the pitcher's release point to the bat-ball contact point at home plate, thereby encouraging the batter to employ the necessary head, eye and body movements so vital to batting success. These devices are also very technical, complicated and expensive.

What is needed is a device that directs the emphasis away from actual ball contact, but instead directs the focus on the many elements of desirable batting techniques so difficult for many batters to master.

SUMMARY OF THE INVENTION

The principal objective of the present invention is the provision of an improved batter training pitch simulator whereby the batter is offered realistic ball following characteristics simulating the path, speed, movement, location, approximate size, and thereby the visual perception of an actual pitch traveling from the release point of the pitcher to the desired bat-ball contact point at home plate.

A further objective of the present invention is to inform the batter the precise moment the pitch is at the exact position ideal bat-ball contact should be made.

A further objective of the present invention is a batter training device that places the pitch in the exact desired location every time.

A further objective of the present invention is to simulate the movement of any type of fastball or breaking ball from either a right- or left-handed pitcher.

A further objective of the present invention is a batter training device that will eliminate the frustrations, distractions and time delays associated with the use of real balls and actual ball contact, enabling the batter to concentrate more time and concern on the techniques that will truly improve his skills.

The foregoing objectives can be accomplished by a batter training device capable of simulating the path, speed, movement, location and visual perception of a ball on its path to home plate by means of a plurality of individually placed and sequentially timed light sources, of approximate baseball size, which are supported on individually movable, placable, and height adjustable support means, such as standards, which can be positioned by the user to simulate the trajectory of a real pitch of any type—fastball or curve ball—starting at the release point of the pitcher and culminating at the ideal bat-ball contact point at home plate. Therefore, a simulation is created whereby the batter can employ all the necessary head, eye and body movements and the precise changes in body balance so vital to batting success.

In addition, at the exact moment of illumination of the bat-ball contact light source, a sound device is activated. This sound presents an added learning dimension informing the batter audibly to when ideal bat-ball contact should be made. This unique feature is offered by no other training device.

It becomes obvious, of course, the batter cannot make actual bat contact with the bat-ball contact point light source, and it is not the intention of the present invention to do so. Conversely, it is the intention of this device to eliminate the distractions and delays of actual ball contact and to be a teaching device solely devoted to developing proper batting or swinging techniques.

The nature of this device, therefore, requires a specially adapted bat. This adapted bat could be a weighted short bat; short enough so a proper swing will not connect with the bat-ball contact light source when a normal swing is taken. The placement of this light source would would correspond to where the sweet spot on the barrel of a bat would make perfectly timed contact if a conventional bat were used. The adapted bat could be a conventional bat cut down to about 18 inches for an adult and about 16 inches or less for a youth, and weighted at the shortened barrel end to compensate for the loss of weight and drag of the removed barrel end. With the weight added to the remaining handle end, the bat retains the approximate feel of the original bat and permits an otherwise normal swing to be taken. The adapted bat could also be made of metal sections of pipe of the desired length, weight and thickness. Another alternative offered the batter is to hold a conventional bat and not swing fully, just concentrating on the pitch and stepping into the pitch without making contact.

Even without a bat in his band, the present invention permits a batter to take his stance and develop a feel for certain types of pitches and practice the body movements and timing necessary to attack those pitches properly.

Further objectives and advantages of the present invention will become apparent from a consideration of the drawings and ensuing description of it.

DRAWING REFERENCE NUMERALS

1 through 12—Cam number and firing order
1A through 12A—Line cord numbers
1B through 12B—Light source numbers
18—Pitch simulator
20—Timer
22—Line cable bundle
24—Batter's focus board
25—Batter's focus board support stand
26—Illustration of right-handed pitcher
27—Batter's focus board frame
28—Windup indicator light
29—Windup light insert opening
30—Release point light
31—Release point light insert opening
32—Light source support standard
33—Face of focus board
34—Lamp assembly inserts
36—Light source
42—Bat-ball contact light source support standard
44—Sound activator
46—Home plate
48—Standard base
50—Male line cord connector
52—Pin insert sleeve
54—Insert pin
56—Lower support section
58—Middle support section
59—Top support section
60—Lamp cord
62—Threaded lamp pipe
64—Standard lamp socket
66—Pivot point of batter's focus board
67—Horizontal axle
68—Illustration of left-handed pitcher
69—Washer
70—Female line receptor with firing order number
71—Dual female line receptor
72—Wing nut

DETAILED DESCRIPTION

Figure 1:
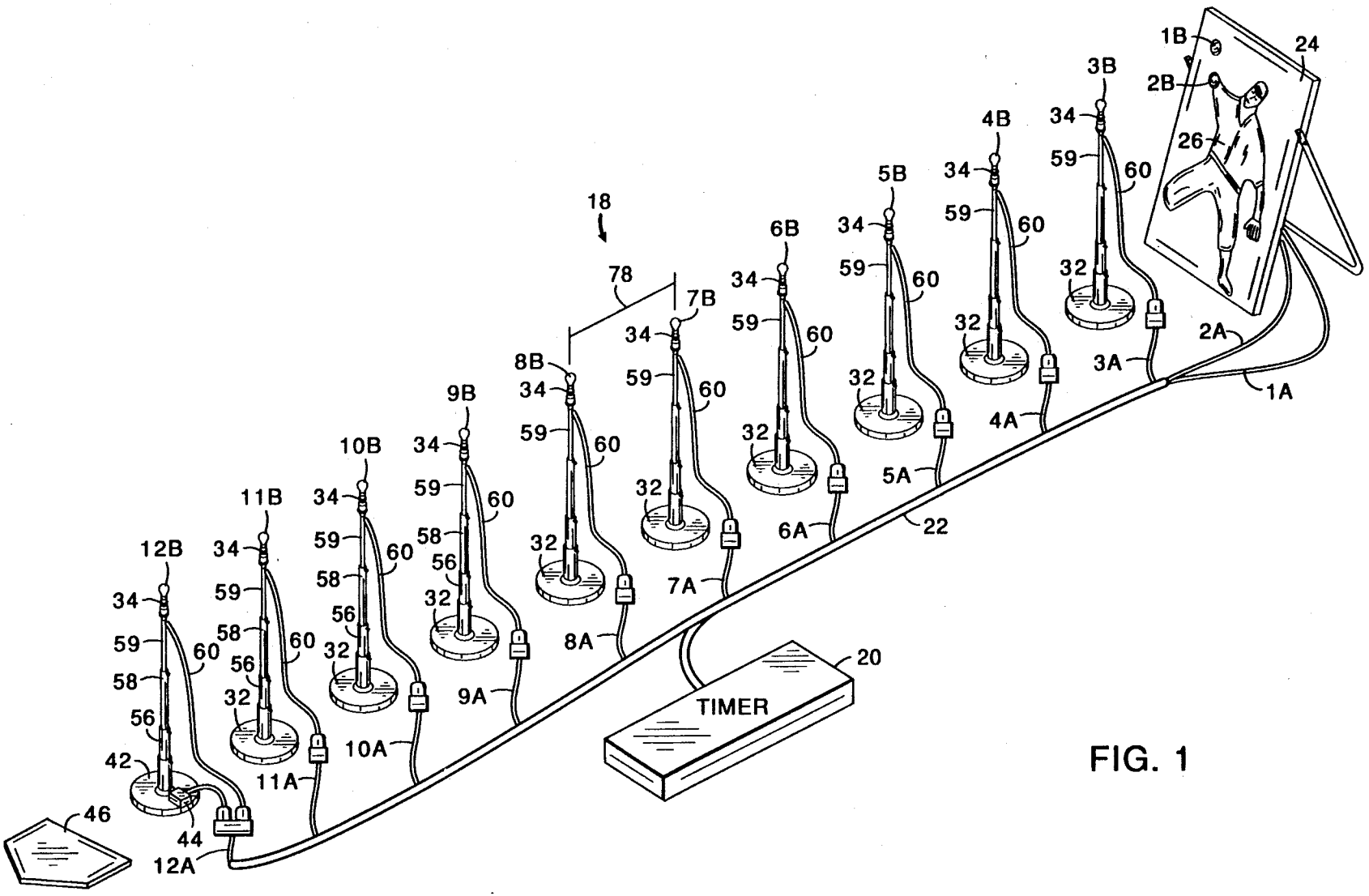
FIG. 1 is a perspective view of the baseball pitch simulator in a fastball mode.

As shown in FIG. 1, the preferred baseball pitch simulator 18 of the present invention includes a timing device 20, suggested in block form, to control the activation of light sources 1B through 12B creating the sequencing lights pitch simulation.

For the purpose of this description of the preferred embodiment the timer 20 used is a commercial twelve cam timer repeating a continuous, adjustable on-off electrical cycle, AC motor driven, with the repeat cycle every seven seconds. This timer 20 is manufactured by the Veeder-Root Company, Hartford, Conn.

Figures 8A, 9:
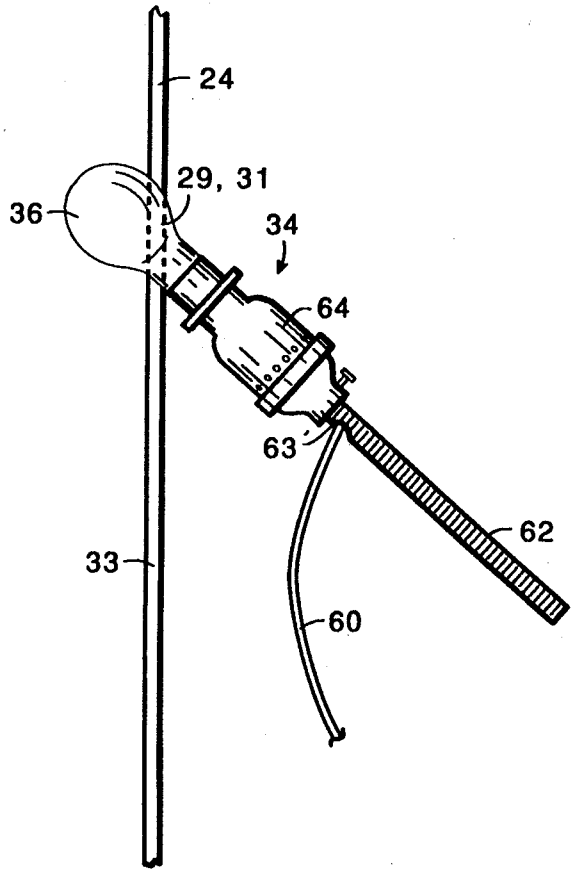
FIG. 8A is an enlarged view of the lamp insert assembly placed and supported in an insert hole.
FIG. 9 is a chart indicating the cam firing order and subsequent line cord designation.

Each cam individually opens and closes a separate electrical switch which activates one of twelve standard female line cord receptacles 76 best shown in FIG. 9. These receptacles 76 are connected to individual lamp line cords 1A through 12A which lead to and sequentially illuminate the light sources 1B through 12B, as illustrated in FIG. 1. Referring again to FIG. 1, the first light source 1B activated by timer 20 is the windup light 28 located on the batter's focus board 24 which is above the pitching arm of the illustrated right-handed pitcher 26. The second light source activated is the release point light 30, 2B in the firing order, on the batter's focus board 24.

Figure 5:
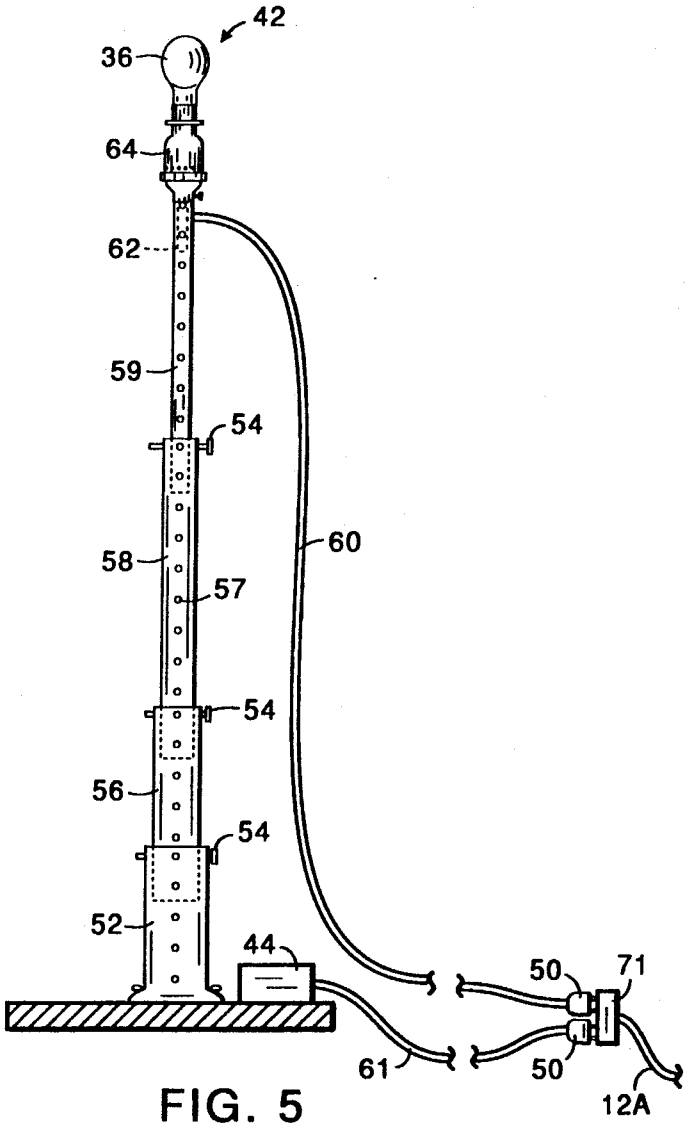
FIG. 5 is a cross-sectional view of the bat-ball contact support standard with the sound activating device.

The activation of the release point light 30, 2B in the firing order, starts the simulated pitch on its predetermined path to home plate 46. Each succeeding light source 3B through 11B is supported on top of a height-adjustable and individually placable support standard 32. The desired simulation of a moving pitch culminates with the illumination of the bat-ball contact light source 12B located on support standard 42. Support standard 42 also contains the sound activating device 44. At the precise moment the bat-ball contact light source 12B is activated the sound device 44 is activated. As illustrated in FIG. 5 light source 12B and sound device 44 share the electrical impulse from line 12A.

The sound device 44 used in the preferred embodiment is a Tonepak Buzzer, 8-16 volts AC, manufactured by Lee Electric Inc., West New York, N.J.

Figure 3:
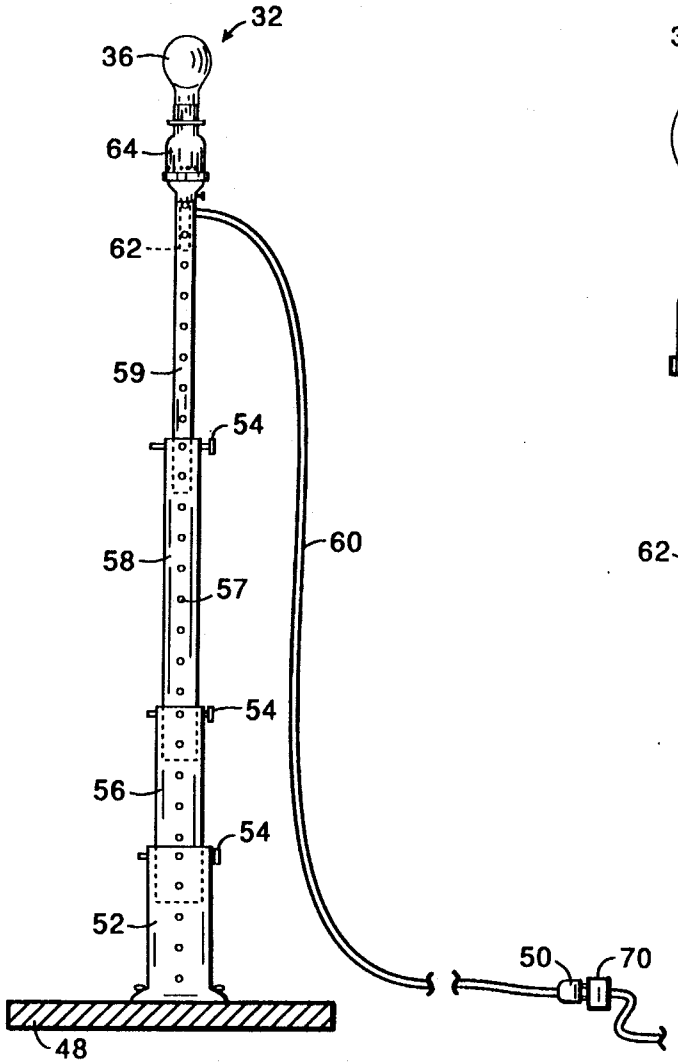
FIG. 3 is a cross-sectional view of the light source support standard.

FIG. 3 in the drawings illustrates the construction of the light support standard 32 of which there are nine in this example of the present invention. A stable base 48 has centered and secured on it a support sleeve 52 of approximately six inches in height for the insertion of the lower support section 56. All support sections 56, 58, 59 are of elongated hollow rigid material tubes, such as PVC plastic or aluminum, of diminishing diameter so as to snugly fit into the section below it. Inserted into lower support section 56 is the middle support section 58. The amount of insertion is determined by the use of insert pinholes 57 located in each section and an insert pin 54 passing through the appropriate pinhole 57 for the desired height. The upper support section 59 inserted in middle support section 58 is supported in the same manner as the middle support section 58 by the use of an insertion pin and insert holes.

Figure 4:
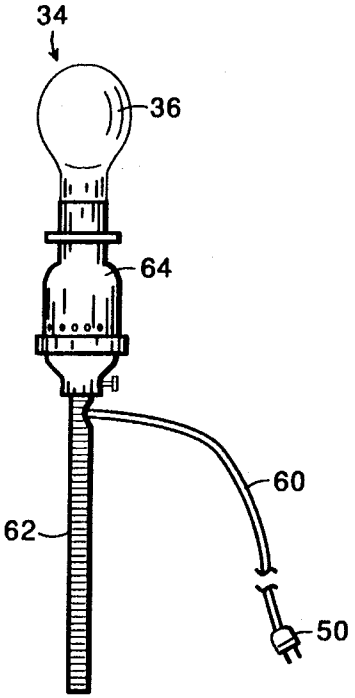
FIG. 4 is a cross-sectional view of the light source assembly insert.
Figure 8:
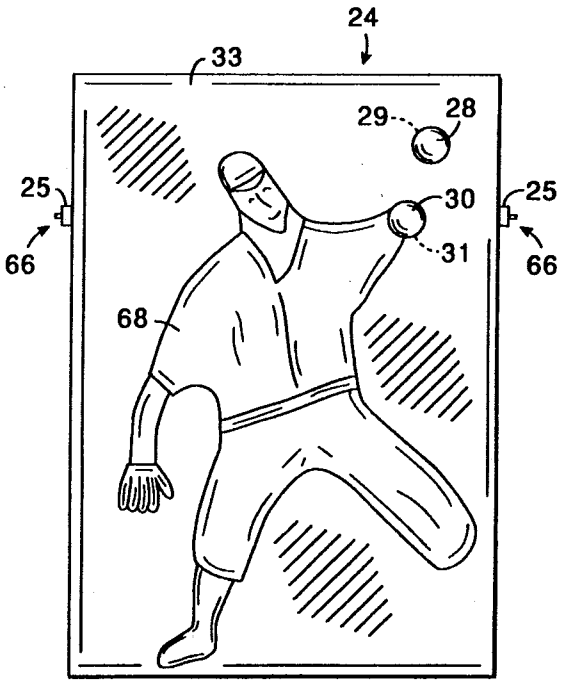
FIG. 8 is a frontal view of the batter's focus board illustrating a left-handed pitcher.

All light sources 1B through 12B are contained on individually removable lamp assembly inserts 34 the construction of which is best shown in FIG. 4. It shows a light source 36 inserted into a standard lamp socket 64. The light sources 36 are standard forty watt incandescent frosted household light bulbs although other light sources could be used. Attached to lamp socket 64 is a length of approximately six inches of threaded lamp pipe 62. Just below the base of lamp socket 64 an exit hole 63 is provided in the lamp pipe 62 for lamp cord 60 to pass through. At the end of this lamp cord 60 is a male connector 50 which inserts into female receptacle 70 which is located at the end of each lines 1A through 11A. The end if lamp cord 12A had dual female receptacle 71. The lamp assembly inserts 62 are all interchangeable and can be placed on any support standard 32 or 42, on any support standard section 56, 58, 59 and on the support standard sleeve 52. The lamp assembly inserts 34 are also positioned in the lamp assembly insert openings 29 and 31 illustrated by broken lines in FIGS. 6 and 8 and best shown on the batter's focus board 24 in FIG. 8A.

As shown in FIG. 8A the insert opening 29, or 31, has a diameter large enough to allow the lamp insert 34 to be placed through it but too small for the light source 36 to pass through. The light source 36 is thereby securely held in its desired position.

Figure 2:
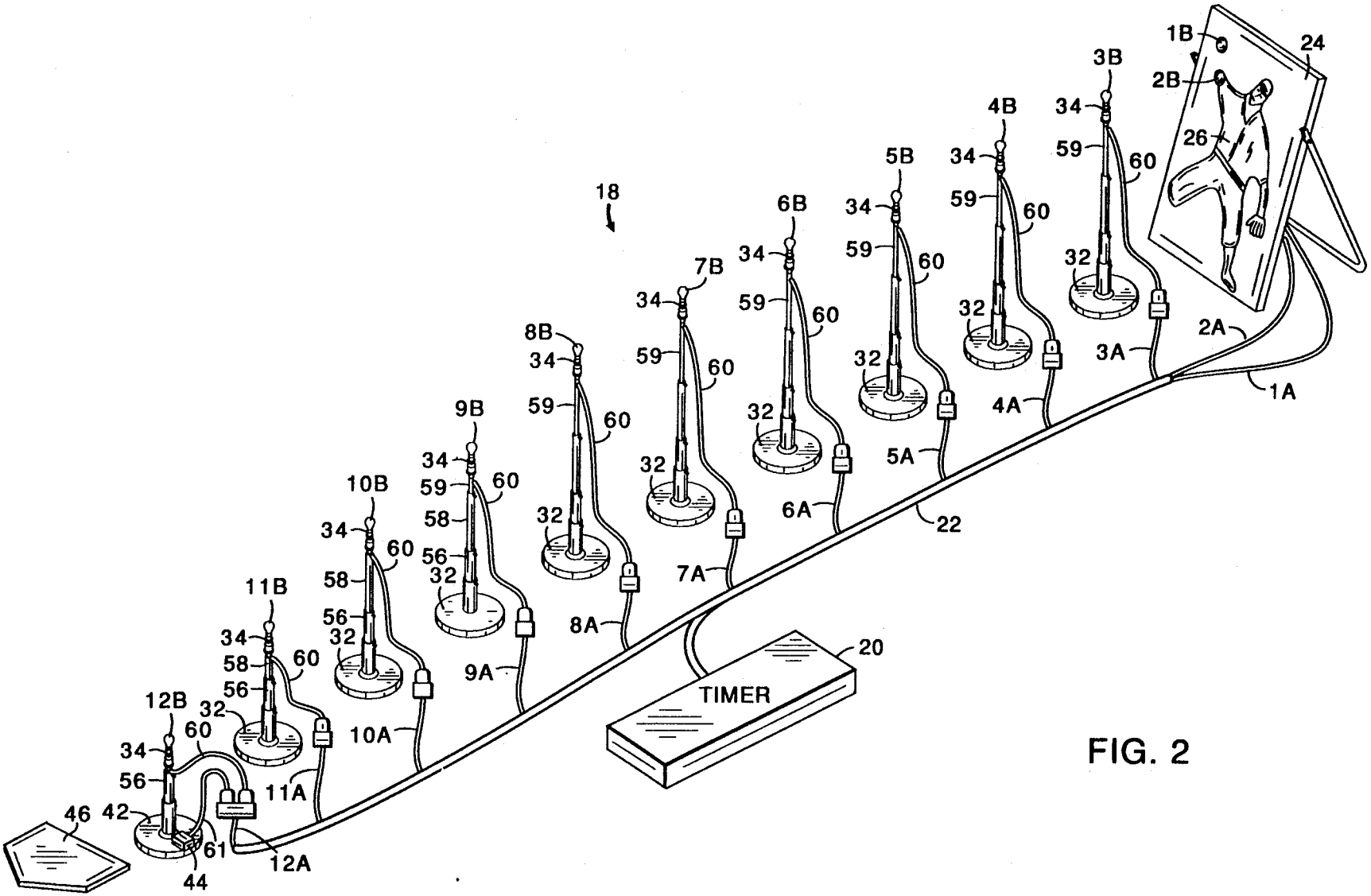
FIG. 2 is a perspective view of the device of FIG. 1 in a breaking-ball mode.

FIG. 2 shows the lamp assembly inserts 34 placed in varying support sections 56, 58, 59 to indicate a downward breaking-ball movement which is created by progressively lowering and moving away from a right-handed batter selected support standards 32 and 42 therefore changing the relative positions of light sources 9B, 10B, 11B and 12B and presenting a curve-ball trajectory.

As an alternative to the use of insert pins 54 a friction connection or a screw type connection of each support section 32, 42 could be used to adjust the height of the support standards 32 and 42 as well as other methods.

FIG. 5 illustrates the construction of the bat-ball contact standard 42 which is identical to support standard 32 except it contains the sound activating device 44. The sound activating device 44 is connected to line **12*a* by line 61 with male connector 50 at its end inserted into female receptacle 71**.

Figure 7:
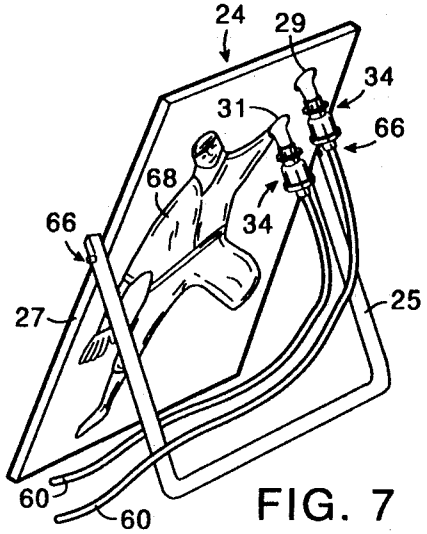
FIG. 7 is an illustration of the rear of the batter's focus board.
Figure 6:
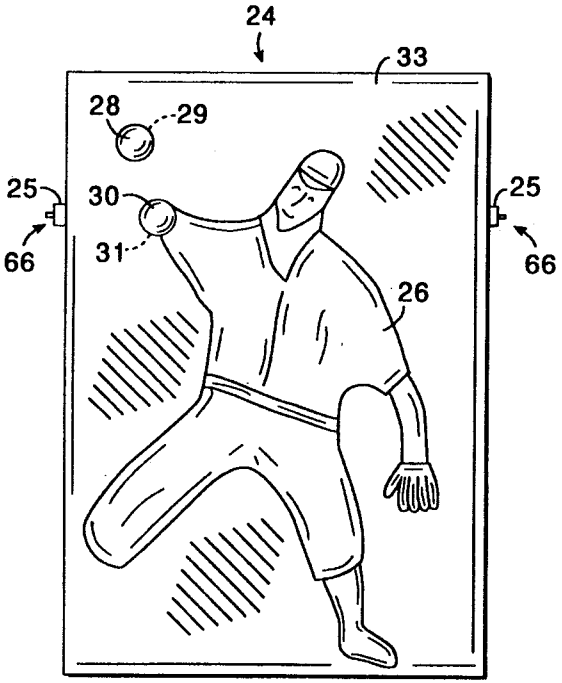
FIG. 6 is frontal view of the batter focus board showing an illustration of a right-handed pitcher.

FIG. 6 illustrates the batter's focus board 24 showing an illustration of a right-handed pitcher 26. The face 33 of the batter's focus board 24, in this embodiment of the invention is made of one-quarter inch thickness rigid paneling such as plywood of approximately six feet by four feet in size and is supported around its perimeter by a rigid material frame, such as a two- by three-inch wood frame 27. Also shown is the position of the warm-up light 28, the warm-up light insert opening 29 indicated by broken lines and the release point light 30 with the release point light insert opening 31 also indicated by broken lines. The batter's focus board 24 is supported by a rigid material stand 25, such as two- by three-inch wood members best shown in FIG. 7 illustrate the reverse side of the batter's focus board 24.

Figure 7A:
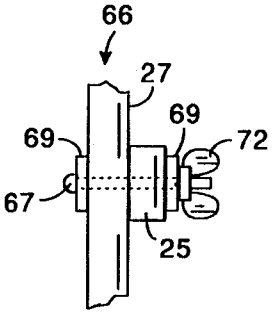
FIG. 7A is an enlarged fragmentary side perspective of the pivot joint.

Located on each side of the batter's focus board 24 is a pivot joint 66 holding the frame of the focus board 27 and the focus board support stand 25. This pivot joint 66 is shown in FIG. 7A. It is comprised of a horizontal axle 67 such as a machine bolt, which passes through both the frame 27 and support stand 25 two washers 69 and wing nut 72. To change the focus board 24 to a left-handed pitcher 68 the lamp inserts 34 are disconnected and removed. The wing nuts 72 on each side of the focus board 24 are loosened and the support stand 25 is raised up and over to the opposite side and the wing nuts 72 tightened. The focus board 24 is then faced to have plate 46 and the two previously removed lamp inserts 34 are replaced and reconnected. The windup light 28 and the release point light 30 are now in position for a left-handed 68 delivery. The support standards 32 holding light sources 3B through 11B would then be individually placed to create the trajectory desired for a left-handed pitch and bat-ball contact light standard 42 holding light source 12B would then be placed at the desired bat-ball contact point consistent with the newly set trajectory.

Figure 10:
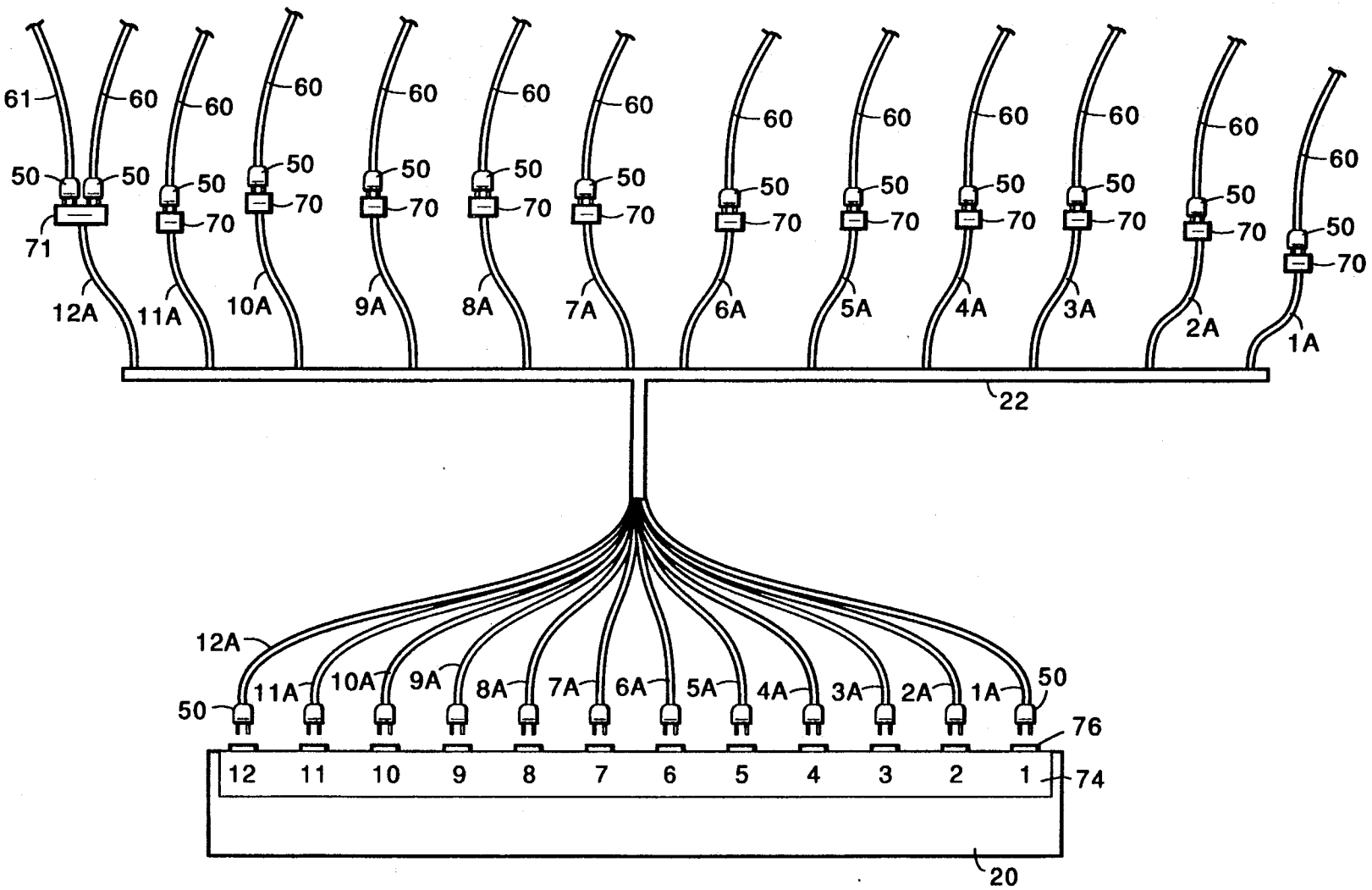
FIG. 10 is a diagramatic illustration of the timer and line cord hookup.

Attention is now drawn to FIG. 10 of the drawings. Located on timer 20 are twelve standard female electrical line Cord receptacles 76 each activated by its own cam. Each receptacle is clearly numbered 74 on the timer 20 indicating its sequence in the firing order and to insure a proper hookup match to the correct male connectors 50, which are also numbered according to their progression in the firing order on lamp cord line 1A through 12A. The cam firing order and hookup sequence is also shown on the chart in FIG. 9. At the other end of each line 1A through 11A is a female receptacle 70 similarly numbered with the firing order number to insure its correct connection to the appropriate lamp assembly insert 34 lamp cord 60 and male connector 50 in the sequence. Lamp cord 12A which leads to the bat-ball contact standard 42 with light source 12B and the sound activating device 44 has at its end a dual female receptacle 71 to accommodate the male connector 50 from both light source 12B and the sound activator 44.

Referring again to FIG. 10 it is shown all lines 1A through 12A are contained in a common cable bundle 22 to further facilitate ease and accuracy of the hookup procedure.

To illustrate the relatively small space necessary to utilize the present invention the light sources 2B through 12B shown in FIG. 1 are placed two feet apart limiting the simulated pitch distance to twenty feet, although more or less space and spacing could be used.

OPERATION OF INVENTION

In use to properly align the present invention the batter, with a conventional bat, takes his stance at home plate 46 and determines the type of pitch to be simulated and where ideal bat-ball contact should be made on the sweet part of the bat for that pitch. Example, for an inside fastball, shown in FIG. 1, contact should be made well out in front of the plate, but for a low and away breaking ball, as shown in FIG. 2, contact could be made over the outside corner of the plate 46. The bat-ball contact standard 42 supporting light source 12B is first placed at the selected location and height. The remaining plurality of standards 32, supporting light sources 11B to 3B are then individually placed and height adjusted at two-foot intervals 78 in FIG. 1 working out from the contact standard 42 toward the release point light 30, light source 2B on the batter's focus board 24, simulating the desired path of the chosen pitch.

The timer 20 at this time could, by proper manual adjustment of each cam around the cam shaft, set the simulated pitch speed to an desired velocity from relative Little League speed to major league speed.

When the timer 20 is started, with the batter now having a form of adapted bat, or one of its alternatives, light 1B is the first activated. This light remains illuminated for approximately one and one half seconds to suggest the time a pitcher is performing his wind-up movements. One-half second after the windup light 28, 1B in firing order, goes off the release point light 30, 2B in firing order, is illuminated thereby starting the simulated pitch on its path to home plate 46 via light sources 3B through 12B. The rationale for the aforementioned one-half second delay between the windup light 28, 1B in firing order, and illumination of the release point light 30, 2B in firing order, is to offer the batter an focusing on the pitcher's procedures before the actual release of the pitch to maximize his timing techniques. Hence the term batter focus board 24.

The batter, whether he uses a weighted short bat and takes a full swing, or a conventional bat takes a half swing without pulling the trigger, or if a batter takes his stance without any bat in his hands and just familiarizes himself with a particular type of pitch and practices rolling into that pitch repeatedly, perhaps to enhance muscle memory, he can benefit from this invention. Another feature of this invention is to place the pitches just out of the strike zone, either high, low, inside, outside, and through repeated observation and concentration the batter can improve his knowledge of the strike zone.

It should become obvious, for those skilled in the art, the comprehensive array of teaching and learning opportunities afforded by the present invention and that it achieves, at least, its stated objectives.

While my above description contains many specifics, these should not be construed as limitations, but rather an exemplification of one preferred embodiment. Many other variations are possible. Accordingly, the reader is requested to determine the scope of the invention by its appended claims and not by the examples which have been given.

I claim:

1. A batter training pitch simulator comprised of a plurality of sequentially timed and illuminated light sources of approximate baseball size, said light sources placed on individually positioned and height adjustable support means, said support means capable of orienting said light sources in specific heights, location and spacing from the pitcher's release point light source located at the selected pitching mound distance, to the bat-ball contact point at home plate as a means to simulate the path, movement, location and visual appearance of various types of pitches and said batter training pitch simulator to include a means of timing the speed and frequency of said pitches.

2. The batter training pitch simulator of claim 1 said pitch simulator to include a sound device activated precisely when said bat-ball contact light source is illuminated, said sound as a means to add auditory information to aid batter development.

3. The batter training pitch simulator of claim 2 wherein the said release point light source is coordinated with a previously illuminated light source, which is the pitcher's windup light source, said light source indicating the approximate time and duration of a pitcher's windup movement prior to the release of said pitch, said release point light source and said windup movement light source sharing a common support structure said support structure serving as a batter's focus board illustrating a pitcher in ball-release position said support structure being reversible to present on the reverse side said illustrated pitcher to be of the opposite hand.

* * * * *